United States Patent [19]

Abendroth

[11] 4,400,240

[45] Aug. 23, 1983

[54] COKE OVEN DOOR HAVING OUTER AND INNER SEALING BLADES

[75] Inventor: Werner Abendroth, Haltern, Fed. Rep. of Germany

[73] Assignee: Firma Carl Still GmbH & Co. KG, Recklinghausen, Fed. Rep. of Germany

[21] Appl. No.: 324,092

[22] Filed: Nov. 23, 1981

[30] Foreign Application Priority Data

Nov. 27, 1980 [DE] Fed. Rep. of Germany ..... 3044703

[51] Int. Cl.[3] ..... C10B 25/06; C10B 25/16

[52] U.S. Cl. ..... 202/248; 49/485; 202/269

[58] Field of Search ..... 202/248, 269; 110/173 R; 49/480, 481, 484, 485, 495

[56] References Cited

U.S. PATENT DOCUMENTS

| | | | |
|---|---|---|---|
| 4,016,045 | 4/1977 | van Ackeren | 202/248 |
| 4,086,231 | 4/1978 | Ikio | 202/248 |
| 4,124,451 | 11/1978 | Dix et al. | 202/248 |
| 4,217,177 | 8/1980 | Gerding et al. | 202/248 |
| 4,226,679 | 10/1980 | Kelly et al. | 202/248 |
| 4,293,389 | 10/1981 | Clement | 202/248 |

FOREIGN PATENT DOCUMENTS

| | | | |
|---|---|---|---|
| 31130 | 7/1981 | European Pat. Off. | 202/248 |
| 2532097 | 1/1977 | Fed. Rep. of Germany . | |
| 2845045 | 4/1980 | Fed. Rep. of Germany . | |
| 701570 | 12/1953 | United Kingdom | 202/248 |

*Primary Examiner*—Bradley Garris
*Attorney, Agent, or Firm*—McGlew and Tuttle

[57] ABSTRACT

A coke oven door is disclosed which includes a sealing diaphragm mounted between the door body and the door stopper having integral means formed therein to cause resilience adjacent the periphery so that sealing blades mounted along the periphery can be pressed into contact with the door frame under unequal forces.

9 Claims, 3 Drawing Figures

COKE OVEN DOOR HAVING OUTER AND INNER SEALING BLADES

FIELD AND BACKGROUND OF THE INVENTION

The invention relates, in general to coke ovens, and more particularly to an improved coke oven door for closing and opening to an oven chamber, the door being of the type having a door body, a door stopper mounted to the body on a side thereof adjacent to the oven chamber and designed to extend into the oven chamber, the coke oven having a door frame with a sealing surface bordering the opening, at least one planar sealing diaphragm secured to the door body between the door body and the door stopper, the diaphragm having sealing blades extended, along its periphery, inwardly against the sealing surface of the door frame, the sealing blades being mounted to the diaphragm about the outer peripheral area thereof, and spring means for urging the sealing blades against the door frame in order to seal the opening.

West German Utility Model No. 79 14 228 (U.S. Pat. No. 4,293,389)discloses a non-angled sealing diaphragm to which a sealing blade holder for a separate, exchangeable (reversible) sealing blade is welded in a gas-tight manner.

In addition to the foregoing diaphragm sealing technique, by means of a sealing blade, many attempts have been made and designs provided to improve tightness by means of an additional seal, to meet the increased requirements for environmental protection. West German Pat. No. 25 32 097 (U.S. Pat. No. 4,124,451) includes so-called antechamber seals having relatively large antechambers and an additional door frame sealing surface.

Further, West German Offenlegungsschrift No. 26 58 196 (U.S. Pat. No. 4,016,045) discloses a double seal for a coke oven door. The seal comprises a circumferentially extending elastically mounted sealing strip having two mutually parallel legs which come to apply against the chamber frame and enclose a hollow space. This sealing strip, however, is screwed only to the circumference of the door body, not to a throughgoing sealing diaphragm. Also, the two sealing legs are rigidly connected to each other and urged into contact by a single, common spring. If dirt or solid tar deposits behind one of these legs, the other leg automatically can no longer completely apply against the door frame and causes leaks.

SUMMARY OF THE INVENTION

The invention is directed to a fully effective double seal of a coke oven door requiring only one door frame sealing surface and employing a sealing diaphragm system, while eliminating the drawbacks mentioned above.

To this end, the invention provides that two sealing blades extended in parallel to each other are applied against the surface of the door frame, the two sealing blades include an outer sealing blade and an inner sealing blade spaced inwardly of the outer sealing blade along the periphery of the diaphragm, elastic means formed in the diaphragm between the door body and the inner sealing blade and between the two sealing blades for resiliently moving the diaphragm responsive to the spring means so that the two sealing blades can be pressed into contact with the door frame under unequal forces.

Due to the inventive arrangement, the two sealing blades act independently of each other as fully effective seals in contact with a single sealing surface on the door frame, and affect each other only to a negligible extent.

A particularly advantageous provision is that, in order to improve the elasticity, at least one circular weakening groove is moved into the sealing diaphragm between at least one of the door body and the inner sealing blade and between the two sealing blades. This makes it possible to obtain a high flexibility while using a relatively thick sealing diaphragm to which the holders of the sealing blade can be welded without problems, i.e. without warping the material.

In another embodiment, two sealing diaphragms are provided which include an inner sealing diaphragm and an outer sealing diaphragm extended in parallel, spaced relationship, one behind the other in the direction in which the sealing pressure of the sealing blades is to be applied. In this embodiment, the two sealing blades can be spaced apart particularly widely. In addition, the inner system of diaphragm sealing including the inner sealing blade is protected from the cooling influence of the outside temperature by the outer sealing diaphragm system, so that tar condensation is, to a large extent, prevented. This is particularly due to the fact that the space between two sealing diaphragms is also isolated from the air outside and filled with hot gas.

A further particularly advantageous development is that the outer sealing diaphragm is connected to the inner sealing diaphragm through an endless spacer flange and, that in its central area, the outer sealing diaphragm is provided with openings for venting the inner sealing diaphragm.

At the same time, the outer sealing diaphragm is secured to the door body through spacer projections or strips, so that cooling air can penetrate into the space between the door body and the inner sealing diaphragm from the sides.

To reduce the forces to be applied through the spring stacks, a particularly advisable provision is that circular weakening grooves are milled into each of the sealing diaphragms in the vicinity of the clamping area, that is, adjacent the periphery.

A mutually independent sealing contact pressure of the two blades is primarily obtained by providing that the outer sealing diaphragm is provided with bores extended therethrough and the spring means includes spring bolts extended through the bores provided in this outer sealing diaphragm, and means are provided for sealing the spring bolts to the outer diaphragm, for example, by gaskets. To avoid possible leaks, the bores in the outer sealing diaphragm may be omitted while providing, in accordance with the invention, that to transfer the spring force to the inner sealing blade, the spring means includes spring bolts mounted for bearing against the outer diaphragm, and spring stacks between the two sealing diaphragms for transferring force by the spring bolts to the inner sealing diaphragm and the sealing blade. It is particularly advantageous in this connection to provide that the spring stacks include a plurality of cup springs.

Further, especially to obtain a space saving door construction, it may be provided that the spring stacks acting on different sealing blades are provided at neutrally offset locations. The bolts in the spring piles are loaded with a predetermined force and, in addition, they are displaceable within the spring housings.

The novel sealing system is particularly effective if a jamb brick support comprising a propping member mounted to the underside of the jamb brick support for movement in the longitudinal direction of the coke oven is provided.

It is to be mentioned that the small hollow or antechamber bounded by the door frame, the two sealing blades, and the sealing diaphragm may be filled with an inert gas, such as superheated steam, which may be kept under a slight excess pressure relative to the pressure in the oven chamber, to improve the sealing effect. Even the air enclosed in this small space may already produce a sealing effect. This space between the two sealing blades may also be used as an additional, third seal by cleaning it after each closing operation and filling it with a viscous sealing substance or similar pasty material. This may be done in accordance with West German Offenlegungsschrift No. 28 45 045.5.

The following advantages of the invention may be enumerated in addition to those mentioned in the foregoing. A simple, rugged door construction is provided. A simple mechanical cleaning of the two sealing blades and of the diaphragm surface therebetween, in a single operation may be accomplished. A simple, mechanical cleaning of only one sealing frame surface may be achieved. A cooling door body which, due to the small difference between the outer and inner temperatures will not warp at all, or only to a negligible extent results. While changing door seals to the novel system, existing door frame constructions may be maintained.

The object of the invention is to provide an improved coke oven door for closing and opening to an oven chamber, the door being of the type having a door body, a door stopper mounted to the door body on a side thereof adjacent to the oven chamber and designed to extend into the oven chamber, the coke oven having a door frame with a sealing surface bordering the opening, at least one planar sealing diaphragm secured to the door body between the door body and the door stopper, the diaphragm having sealing blades extended, along its periphery, inwardly against the sealing surface of the door frame, the sealing blades being mounted to the diaphragm about the outer peripheral area thereof, and spring means for urging the sealing blades against the door frame in order to seal the opening, the improvement comprising two sealing blades extended in parallel to each other applied against the sealing surface of the door frame, said two sealing blades comprising an outer sealing blade and an inner sealing blade spaced inwardly of said outer sealing blade along the periphery of the diaphragm, elastic means formed in the sealing diaphragm between the door body and said inner sealing blade, and between said two sealing blades for resiliently moving the sealing diaphragm responsive to the spring means so that said two sealing blades can be pressed into contact with the door frame under unequal forces.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF PREFERRED EMBODIMENT

Figure 1:
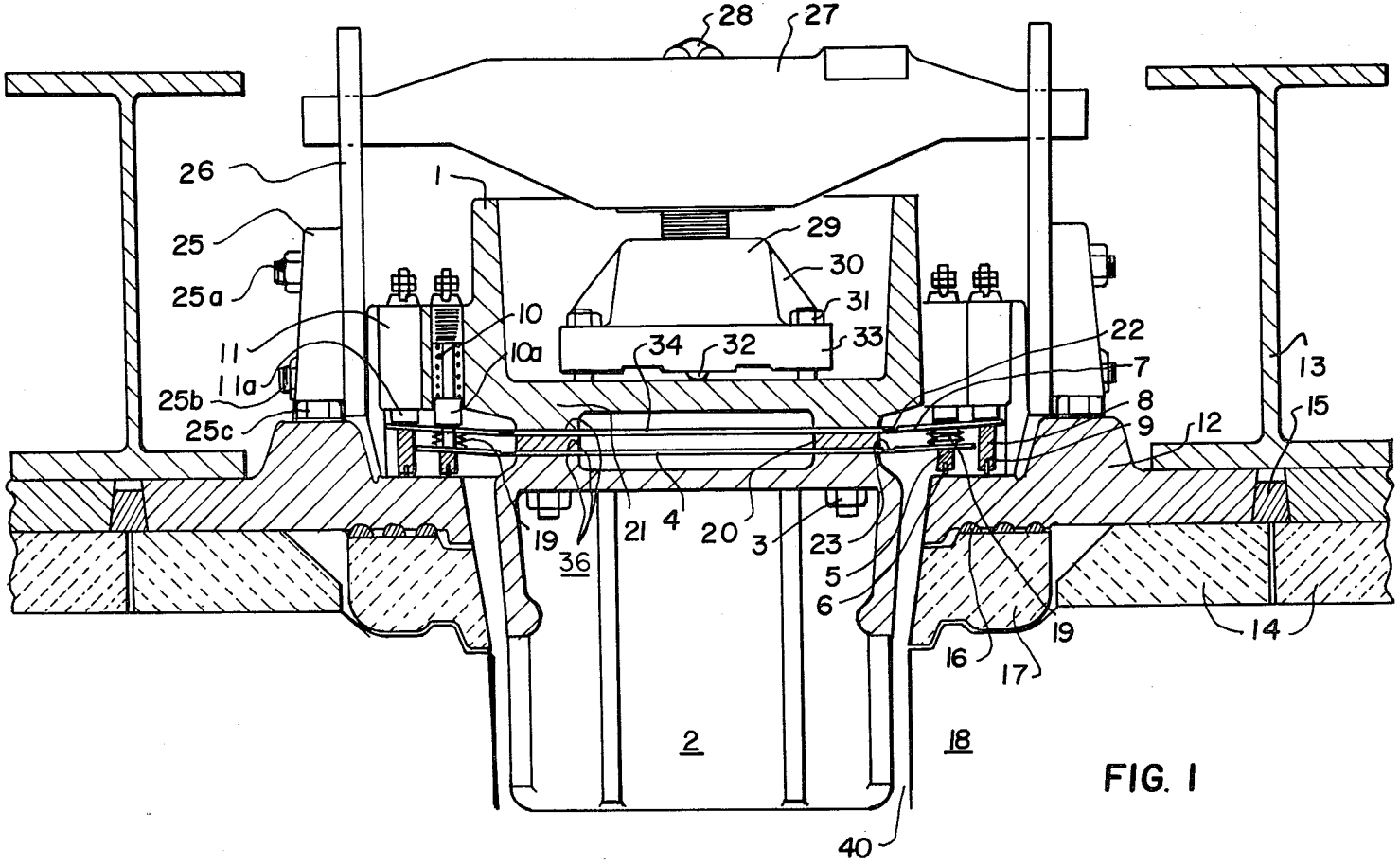
FIG. 1 is a sectional view of a coke oven door inserted in the opening of an oven chamber.

Referring now to the drawings, in particular, wherein like reference characters represent like or corresponding parts throughout the several views, there is shown a coke oven door comprising a door body 1 and a door stopper or plug 2 mounted to the door body 1, by a screw assembly 3, and extending into a coke oven chamber 40. The stopper is usually made as a refractory material.

An anchoring post 13 fits over the door frame 12 which is mounted to a lining or insulation 14 and inner frame brick 17 on the refractory brick work 18 of the coke oven. Seals 15 are provided between the lining 14, the frame 12 and the anchoring post 13, and seals 16 between the frame brick 17 and frame 12. On the outside of the door body 1, door frame ribs 25 are provided for locking hooks 26 into which a cross bar 27 engages. A door locking assembly 28–33 is used to lock the door body in position.

A planar sealing diaphragm 4 is secured to the door body 1 between the door body 1 and the door stopper 2. Sealing blades 6, 9, mounted in respective blade holders 5,8, are provided in the diaphragm 4 so as to extend, from the side of the door body adjacent the chamber 40, continuously along a peripheral area **4*a*** of the diaphragm.

A spring loaded assembly, including springs 10, 11 and spring bolts **10*a*, 11*a*, resiliently loaded by springs 10, 11, bearing against the peripheral area 4*a*, urges the sealing blades into sealing contact with a door frame 12 surrounding an opening to the chamber 40**. The spring loading is adjustable.

Figure 3:
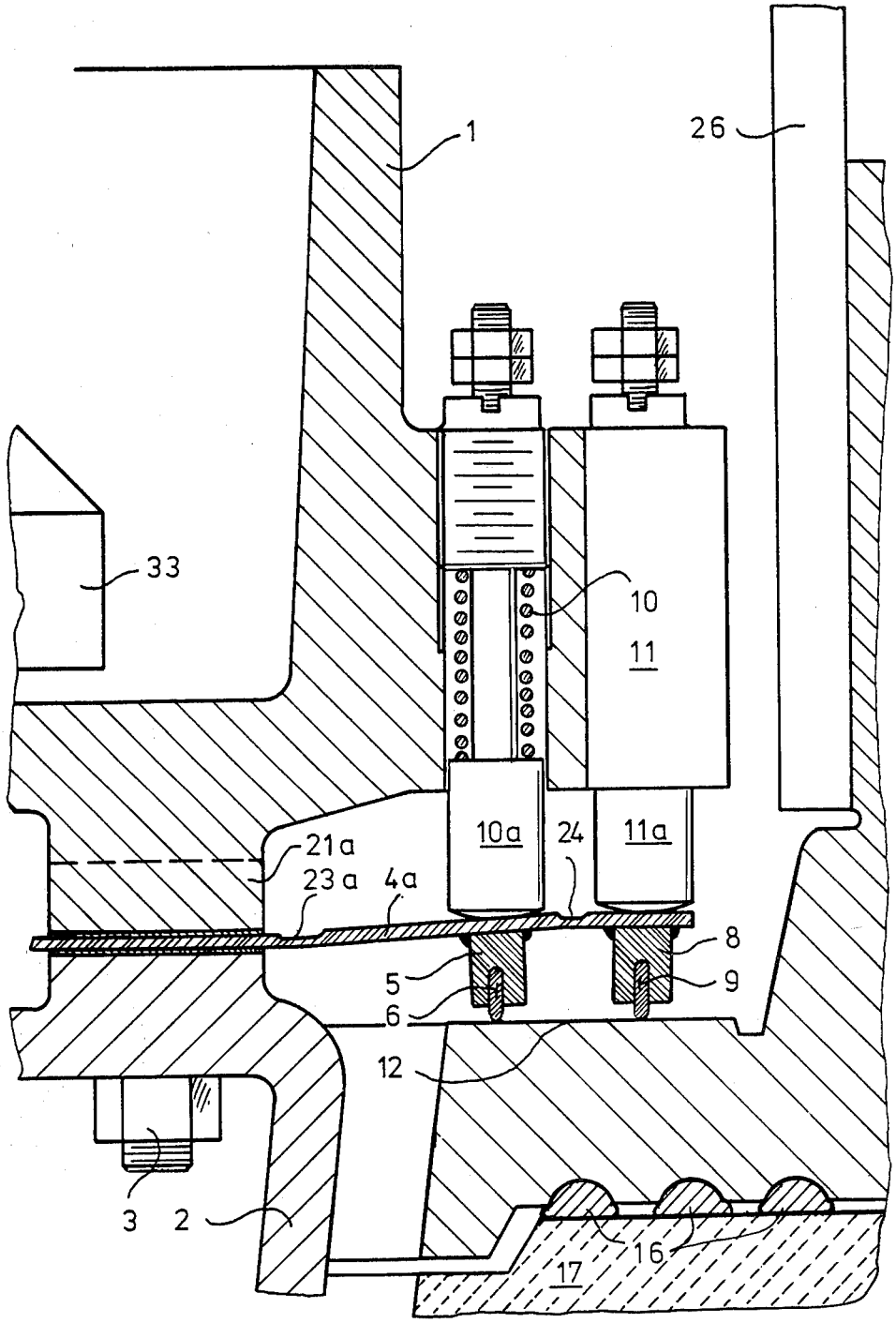
FIG. 3 is a view similar to FIG. 2, with a single sealing diaphragm.

In accordance with the invention, the two sealing blades 6, 9, are provided at the peripheral area **4*a* of the diaphragm 4, extending in parallel to each other such that the sealing blade 6 is spaced inwardly of the sealing blade 9 along the periphery of the diaphragm 4. Both sealing blades 6, 9 are designed to apply against a sealing surface of the door frame 12. The diaphragm 4 extends beyond a portion of the door body in the vicinity of the chamber opening as is perhaps best shown in the embodiment of FIG. 3. Between the door body 1 and the inner sealing blade 6, and between the two sealing blades 6, 9, the diaphragm 4 is designed to be elastic or flexible so that the sealing blades 6, 9 can be pressed into contact with the door frame through spring 10, 11 under unequal forces. To improve the elasticity, at least one periphery wearing groove 23*a*, 24 is milled, or otherswise formed, between the door body 1 and the inner scaling blade or between the two sealing blades 6, 9**.

Figure 2:
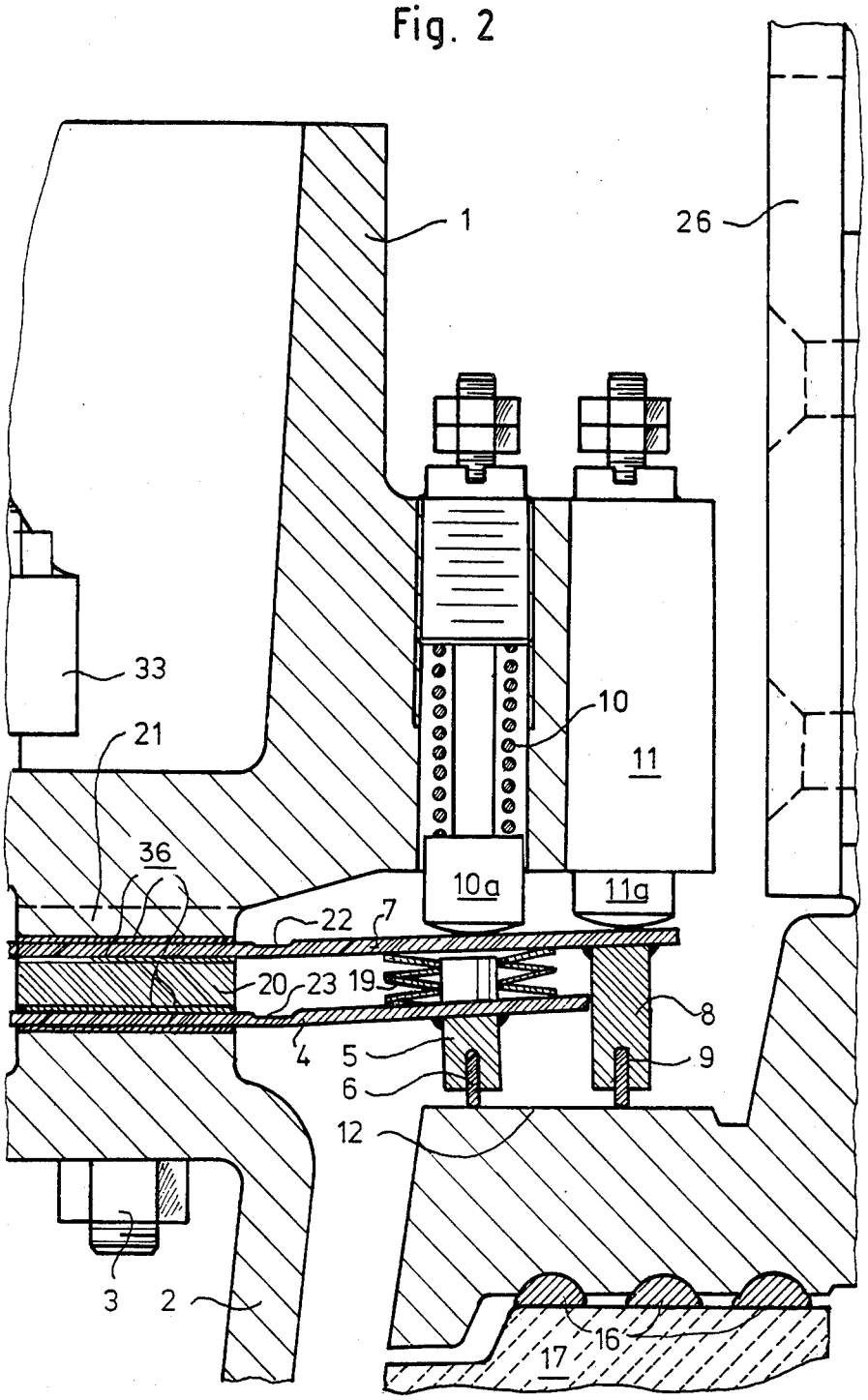
FIG. 2 is an enlarged sectional view of one side of the coke oven door, with two parallel sealing diaphragms.

In accordance with the embodiments of FIGS. 1 and 2, the sealing blades 6, 9 are secured to different sealing diaphragms 4 and 7 which are mounted one behind the other in the direction in which the sealing force or pressure is to be applied.

The outer sealing diaphragm 7 is connected to the inner sealing diaphragm 4 through an endless space flange 20 with seals 36, surrounding an area. The outer sealing diaphragm 7 is provided in its central area with openings 34 for venting the inner sealing diaphragm 4. Peripheral wearing grooves 22, 23 are milled, or otherwise formed, in each of the diaphragms 4, 7 at peripheral locations beyond a portion of the door body in which the diaphrams are engaged. To transfer spring force to the inner sealing blade 6, the spring bolts are mounted (FIG. 1) to extend through the bores provided in the outer diaphragm 7 and sealed by means of a gasket. Alternately, as shown in FIG. 2, to transfer the spring force to the inner sealing blade 6, the spring bolts 10*a* are mounted for pressing against the outer sealing diaphragm 7, with the force applied being transferable to the inner sealing diaphragm 4 and the sealing blade 6 through spring stacks 19 provided between two sealing diaphragms 4, 7. The spring stacks 19 are preferably assemblies of serially mounted cup springs. Spring stacks 19 preferably are so mounted in connection with both sealing blades 6, 9 at mutually offset locations around the periphery of the diaphragm(s).

Thus, in accordance with the invention, there is provided a coke oven door with at least one planar sealing diaphragm secured to a door body between the door body 1 and the door stopper 2, with inwardly, against the door frame 12, extending sealing blades which are provided on the diaphragm in the outer, annular periphery zone thereof and which are urged against the door frame 12 by biased, adjustable springs through a plurality of spring-loaded bolts, in order to seal the system of sealing diaphragms against the door frame, characterized in that at the circumference of the sealing diaphragm 4*a*, two sealing blades 6, 9 are provided which extend in parallel and come to apply against a sealing surface of the door frame 12, that between the door body 1 and the inner sealing blade 6, and between the two sealing blades 6, 9, the diaphragm is designed to be elastic, and that the two sealing blades 6, 9 can be pressed into contact with the door frame, through separate springs 10, 11 under unequal forces.

The inventive door is further characterized in that to improve the elasticity, at least one circular weakening groove 22, 23, 23*a*, 24 is milled into the sealing diaphragm 4*a*, 4, 7 between the door body and the inner sealing blade 6 and/or between the two sealing blades 6, 9.

In accordance with one embodiment, the invention is characterized in that two sealing blades 6, 9 extending in parallel, and coming to apply against the sealing surface of the door frame 12, are secured to two different sealing diaphragms 4, 7 which extend in parallel, one behind the other in the direction of the pressure to be applied.

The inventive arrangement is further characterized in that in the clamping area, the outer sealing diaphragm 7 is connected to the inner sealing diaphragm 4 through an uninterrupted spacer flange 20, and that in its central area, it is provided with openings 34 for venting the inner sealing diaphragm, which are distrubuted vertically. The arrangement is characterized in that a circular weakening groove 22, 23 is milled into each of the sealing diaphragms 4, 7 in the vicinity of the clamping area.

In order to transfer the spring force to the inner sealing blade 6, the spring bolts are mounted to extend through bores provided in the outer sealing diaphragm 7, and are sealed by means of a gasket in accordance with a preferred embodiment, or the spring bolts 10*a* are mounted for bearing against the outer sealing diaphragm 7, with the force applied being transferable to the inner sealing diaphragm 4 and the sealing blade 6 through spring stacks 19 provided between the two sealing diaphragms 4, 7.

The inventive arrangement is still further characterized in that the spring stacks 19 between the two sealing diaphragms 4, 7 are assembled of cup springs.

The inventive arrangement is even still further characterized in that the spring stacks 10, 11 acting on the two different sealing blades 6, 9 are provided on the periphery of the door body 1 at mutually offset locations.

To reduce the locking forces a jamb brick support with a movable propping element may be provided.

While specific embodiments of the invention have been shown and described in detail to illustrate the application of the principles of the invention, it will be understood that the invention may be embodied otherwise without departing from such principles.

What is claimed is:

1. In a coke oven door for closing an opening to an oven chamber of a coke oven, the door being of the type having a door body, a door stopper mounted to the door body on a side thereof adapted to be adjacent the oven chamber and designed to extend into the oven chamber, the door being for a coke oven having a door frame with a sealing surface bordering the opening, the door having at least one planar sealing diaphragm secured to the door body between the door body and the door stopper, the diaphragm having sealing blades adapted to extend, along its periphery, inwardly against the sealing surface of the door frame, sealing blades being mounted to the diaphragm about the outer peripheral area thereof, and spring means for urging the sealing blades against the door frame in order to seal the opening, the improvement comprising two sealing blades extended in parallel to each other adapted to be applied against the sealing surface of the door frame, said two sealing blades comprising an outer sealing blade and an inner sealing blade spaced inwardly of said outer sealing blade along the periphery of the diaphragm, elastic means formed in the sealing diaphragm between the door body and said inner sealing blade, and between said two sealing blades for resiliently moving the sealing diaphragm responsive to the spring means so that said two sealing blades can be pressed into contact with the door frame under unequal forces.

2. In a coke oven door as set forth in claim 1, wherein said elastic means comprises at least one peripheral groove milled into the sealing diaphragm between at least one of (1) the door body and said inner sealing blade and (2) between said two sealing blades.

3. In a coke oven door for closing an opening to an oven chamber of a coke oven, the door being of the type having a door body, a door stopper mounted to the door body on a side thereof adapted to lie adjacent the oven chamber and designed to extend into the oven chamber, the door being for a coke oven having a door frame with a sealing surface bordering the opening, the door having at least one planar sealing diaphragm secured to the door body between the door body and the door stopper, the diaphragm having sealing blades adapted to extend along its periphery, inwardly against the sealing surface of the door frame, the sealing blades being mounted to the diaphragm about the outer peripheral area thereof, and spring means for urging the sealing blades against the door frame in order to seal the opening, the improvement comprising two sealing blades extended in parallel to each other adapted to be applied against the sealing surface of the door frame, said two sealing blades comprising an outer sealing blade and an inner sealing blade spaced inwardly of said outer sealing blade along the periphery of the diaphragm, and further comprising at least two sealing diaphragms including an inner sealing diaphragm and an outer sealing diaphragm extended in parallel spaced relationship, one behind the other in the direction in which the sealing pressure of the sealing blades is to be applied.

4. In a coke oven door as set forth in claim 3, further comprising an endless spacer flange for connecting said outer sealing diaphragm to said inner sealing diaphragm, said outer diaphragm having a central area inwardly of said endless spacer flange and openings in said central area for venting the inner sealing diaphragm.

5. In a coke oven door as set forth in claim 4, further comprising a peripheral groove milled into each of said sealing diaphragms in the vicinity thereof adjacent the periphery.

6. In a coke oven door according to claim 5, wherein said outer sealing diaphragm includes bores extended therethrough, and wherein the spring means includes spring bolts extended through said bores provided in the outer sealing diaphragm, and means for sealing said spring bolts to said outer diaphragm.

7. In a coke oven door as set forth in claim 5, wherein to transfer the spring force to the inner blades, the spring means includes spring bolts mounted for bearing against said outer sealing diaphragm, and further comprising spring stacks between the two sealing diaphragms for transferring force applied by the spring bolts to the inner diaphragm and the sealing blades.

8. In a coke oven door as set forth in claim 7, wherein the spring stacks between said two sealing diaphragms comprises a plurality of cup springs.

9. In a coke oven door as set forth in claim 8, wherein said spring stacks include separate stacks acting on the inner and outer sealing blades at mutually offset locations.

* * * * *